US010816928B2

(12) United States Patent
Moon et al.

(10) Patent No.: US 10,816,928 B2
(45) Date of Patent: Oct. 27, 2020

(54) MEMBER TO MANAGE LOCATION RELATIONSHIP BETWEEN PROCESS ROLLER AND PHOTOCONDUCTIVE DRUM

(71) Applicant: HEWLETT-PACKARD DEVELOPMENT COMPANY, L.P., Spring, TX (US)

(72) Inventors: Ji Won Moon, Pangyo (KR); Yong Il Moon, Suwon (KR); Yong Nam Ahn, Suwon (KR); Yong Kwan Cho, Suwon (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/609,467

(22) PCT Filed: Jul. 4, 2018

(86) PCT No.: PCT/KR2018/007551
§ 371 (c)(1),
(2) Date: Oct. 30, 2019

(87) PCT Pub. No.: WO2019/017622
PCT Pub. Date: Jan. 24, 2019

(65) Prior Publication Data

US 2020/0201241 A1 Jun. 25, 2020

(30) Foreign Application Priority Data

Jul. 18, 2017 (KR) ..... 10-2017-0091004

(51) Int. Cl.
*G03G 21/16* (2006.01)

(52) U.S. Cl.
CPC ..... *G03G 21/1647* (2013.01); *G03G 21/1671* (2013.01)

(58) Field of Classification Search
CPC ..... G03G 21/1647; G03G 21/1671
See application file for complete search history.

(56) References Cited

U.S. PATENT DOCUMENTS

| | | | | |
|---|---|---|---|---|
| 8,086,132 | B2 | 12/2011 | Askren et al. | |
| 2007/0160388 | A1* | 7/2007 | Yoshimura | G03G 21/1842 399/111 |
| 2012/0269543 | A1* | 10/2012 | Hashimoto | G03G 21/1676 399/111 |
| 2015/0003867 | A1 | 1/2015 | Koyama | |
| 2015/0117874 | A1* | 4/2015 | Shiraki | G03G 21/1896 399/13 |
| 2015/0277352 | A1 | 10/2015 | Abe | |

FOREIGN PATENT DOCUMENTS

| | | |
|---|---|---|
| JP | 2004271674 | 9/2004 |
| JP | 2011197531 | 10/2011 |

* cited by examiner

*Primary Examiner* — Gregory H Curran
(74) *Attorney, Agent, or Firm* — Trop Pruner & Hu, P.C.

(57) ABSTRACT

An electrophotographic image forming apparatus includes a photoconductive drum, a process roller to rotate in a state where the process roller elastically contacts a surface of the photoconductive drum, and a connecting member to allow the process roller to follow a movement of the photoconductive drum in an axial direction of the photoconductive drum.

20 Claims, 8 Drawing Sheets

[Fig. 1]
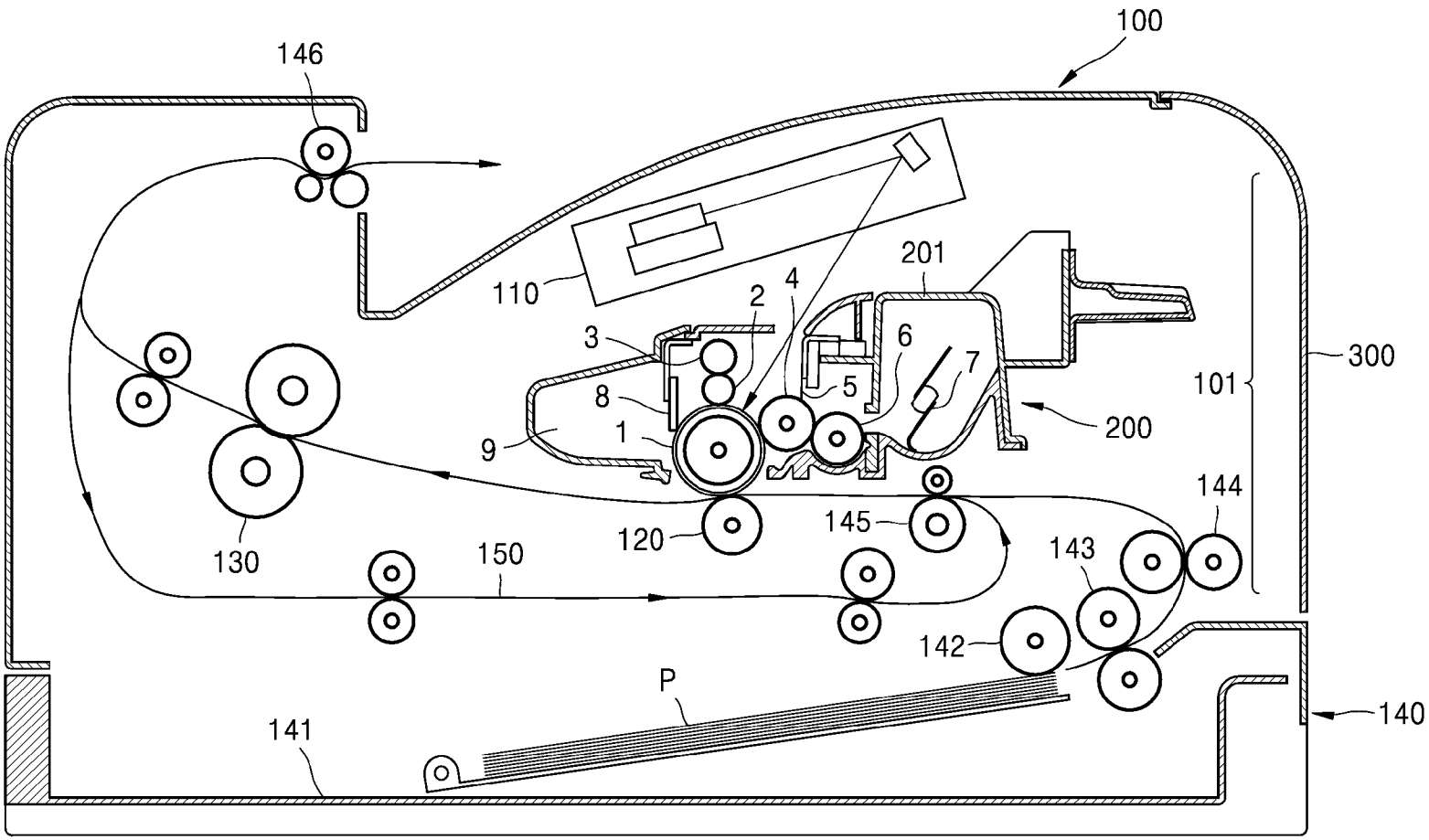

[Fig. 2]
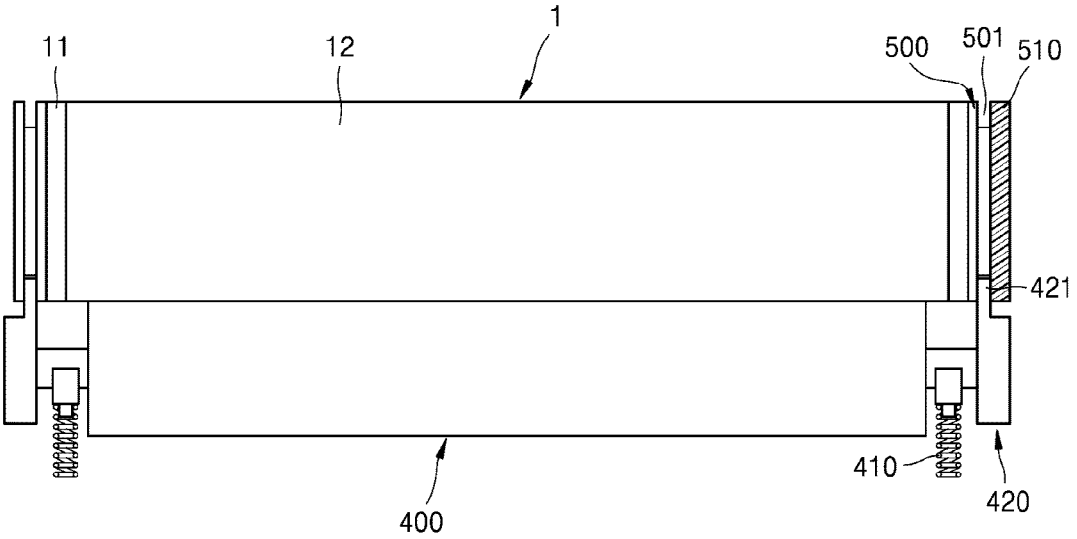
[Fig. 3]
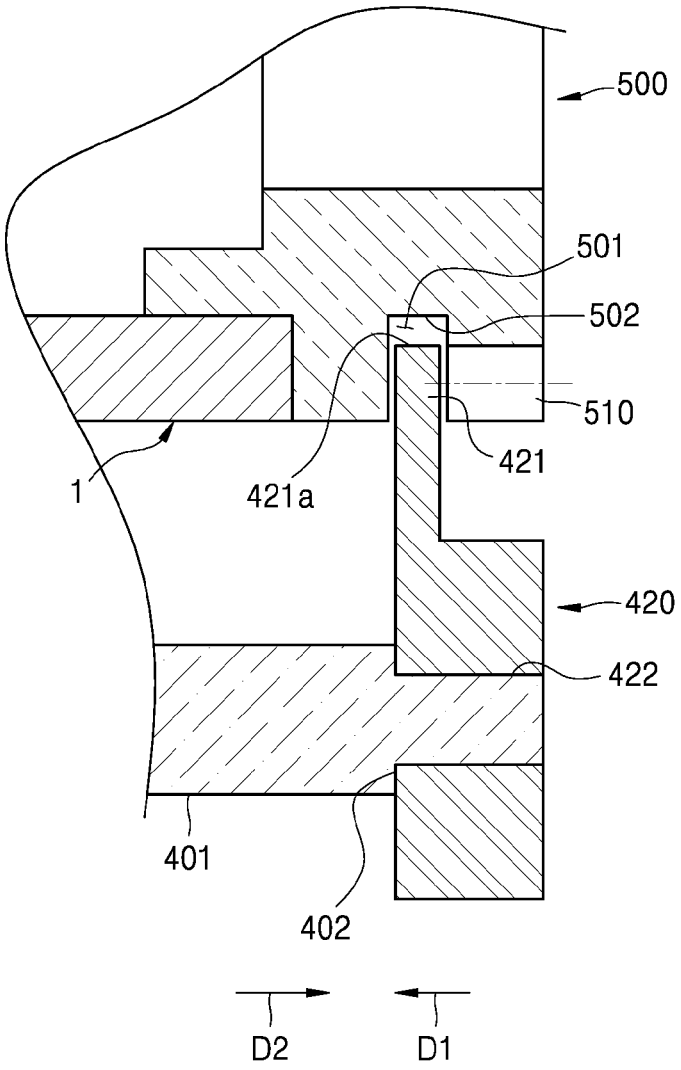

[Fig. 4]
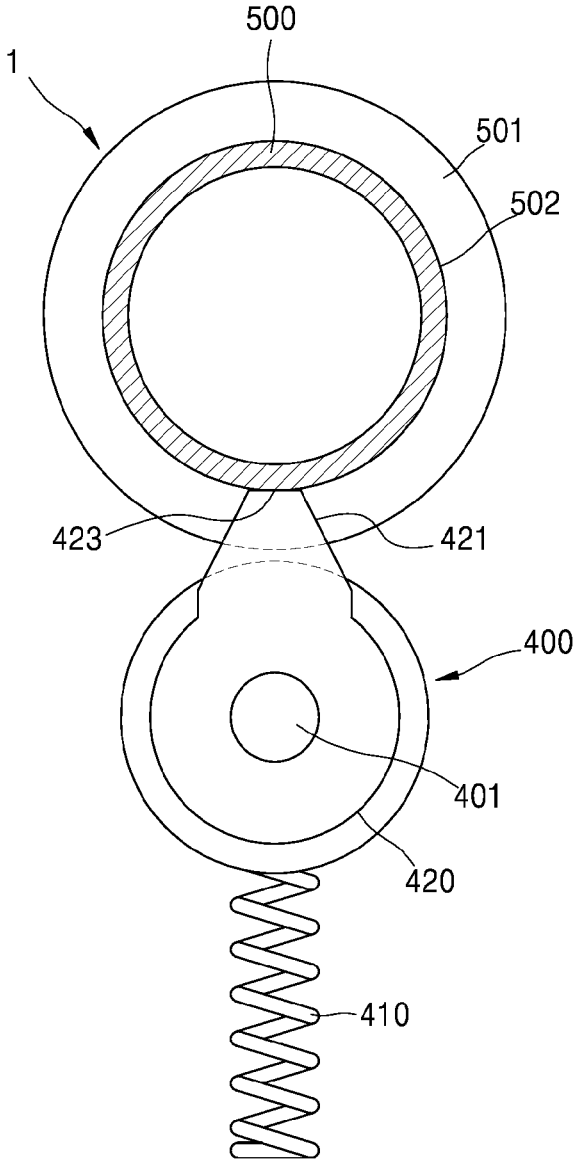

[Fig. 5]
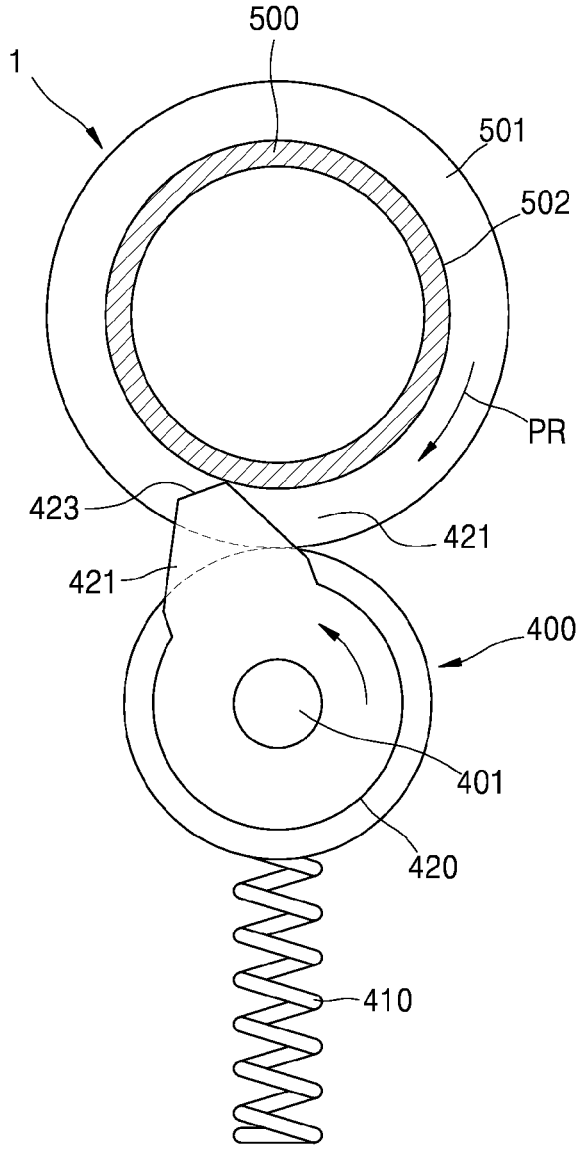

[Fig. 6]
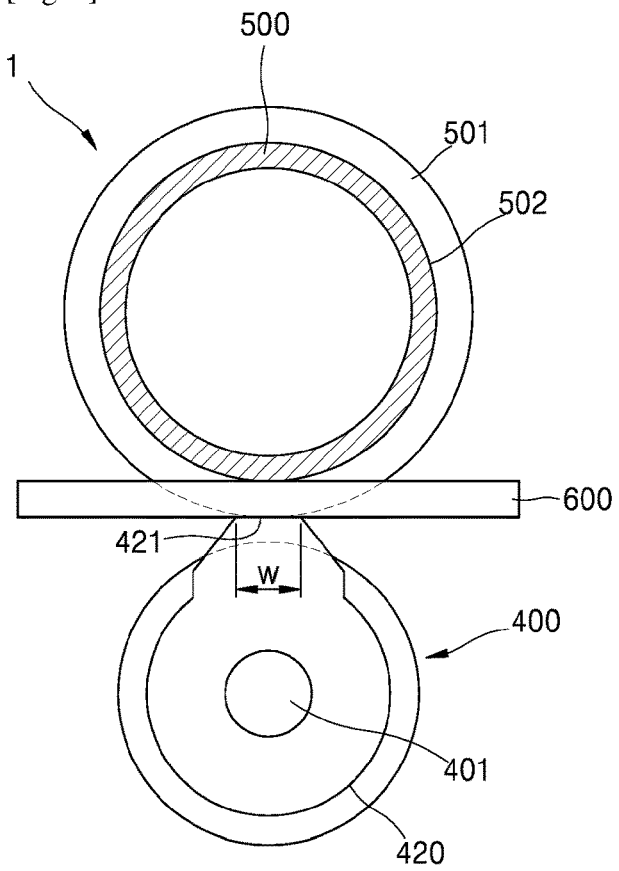
[Fig. 7]
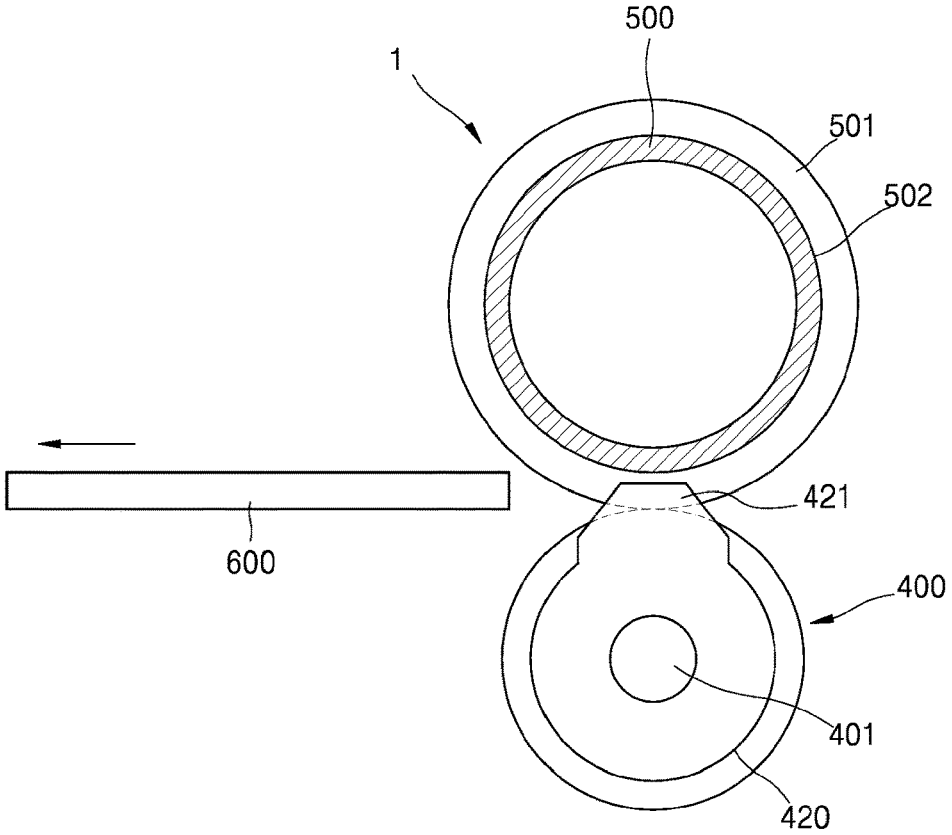

[Fig. 8]
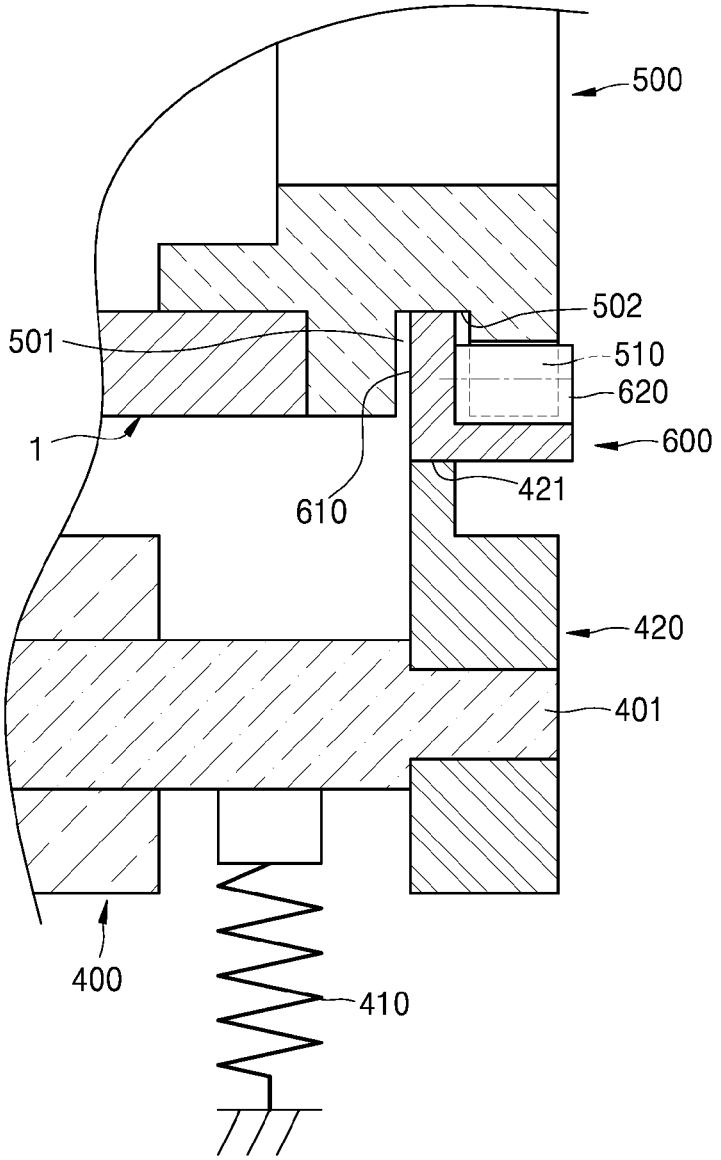
[Fig. 9]
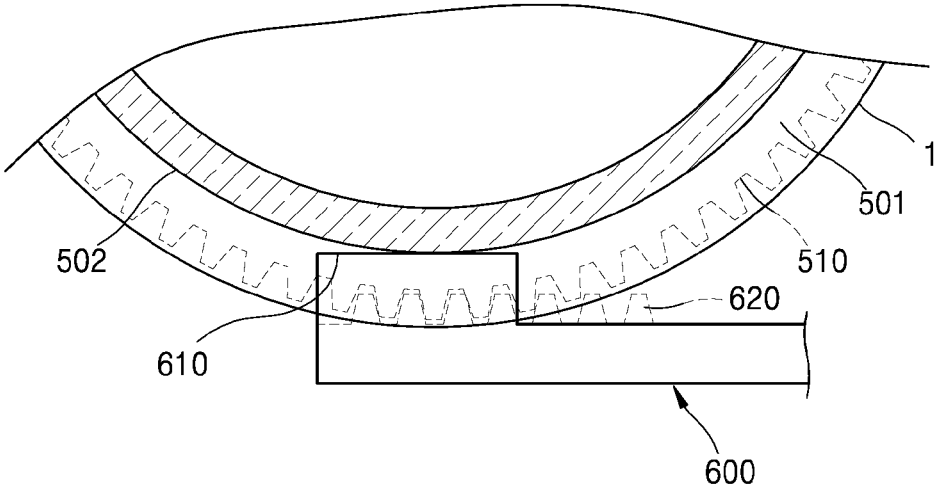

[Fig. 10]
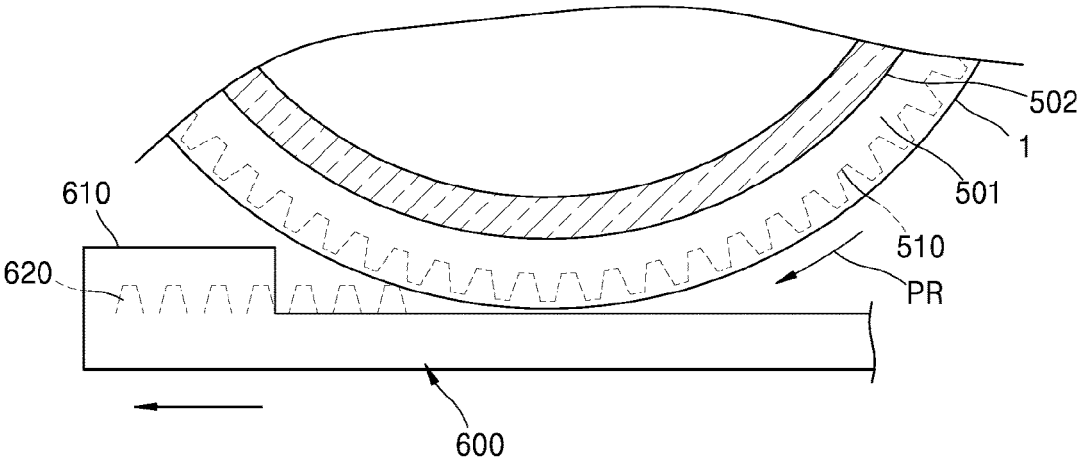
[Fig. 11]
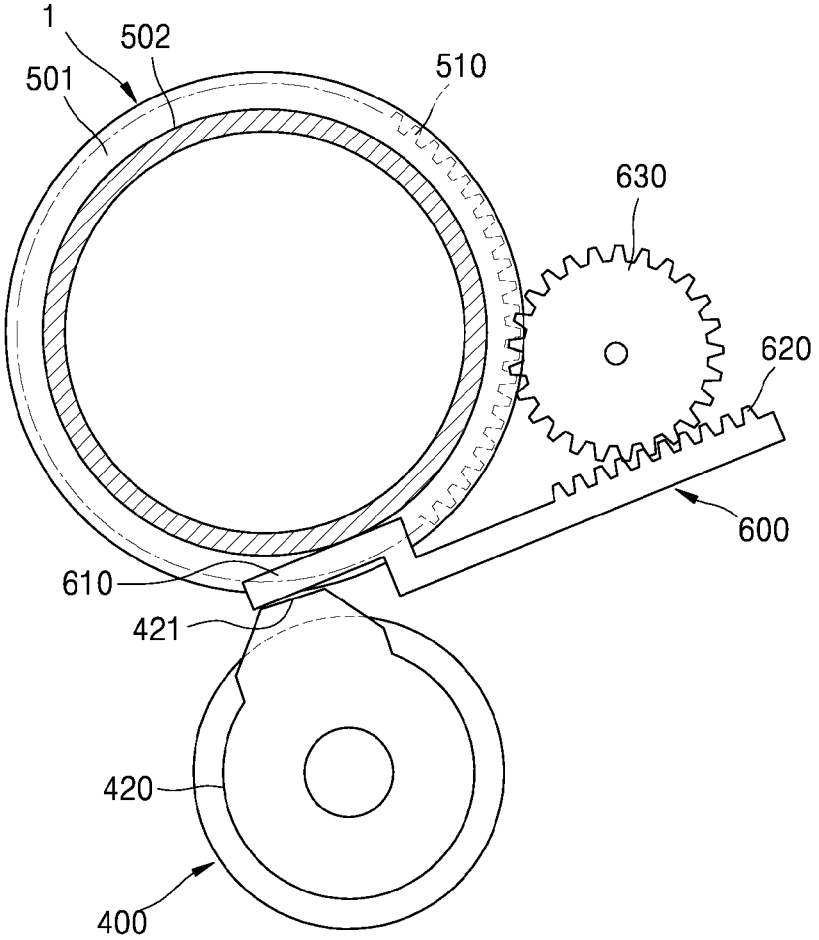

[Fig. 12]
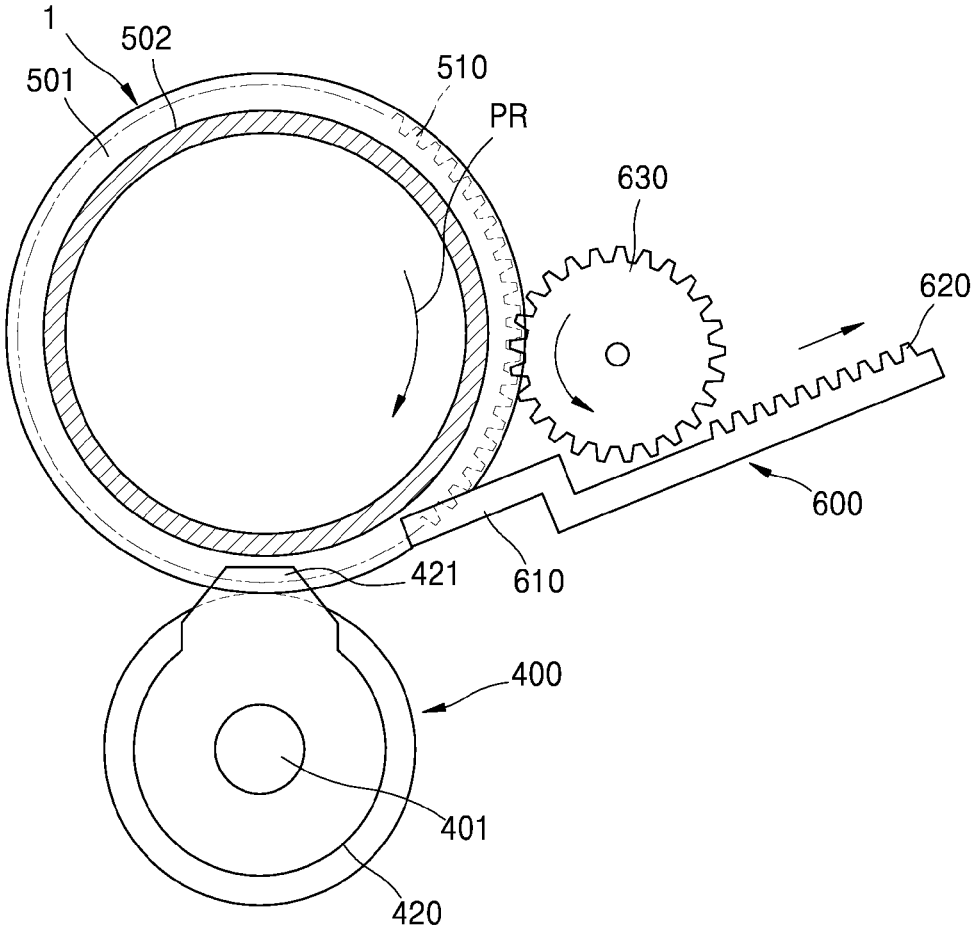

MEMBER TO MANAGE LOCATION RELATIONSHIP BETWEEN PROCESS ROLLER AND PHOTOCONDUCTIVE DRUM

BACKGROUND ART

The disclosure relates to an electrophotographic image forming apparatus for printing an image on a recording medium by electrophotography.

Electrophotographic image forming apparatuses operating in an electrophotographic manner print an image onto a recording medium by forming a visible toner image on a photoconductor by supplying a toner to an electrostatic latent image formed on a photoconductive drum, transferring the toner image to the recording medium, and fixing the transferred toner image to the recording medium.

Electrophotographic image forming apparatuses include a photoconductive drum, and process rollers that are rotated in contact with a surface of the photoconductive drum. The process rollers may be, for example, a charging roller that charges the surface of the photoconductive drum to have a uniform potential, a developing roller that forms a visible toner image by supplying a toner to an electrostatic latent image formed on the photoconductive drum, and a transfer roller that transfers the toner image to a recording medium.

The photoconductive drum is a rotating body, and may move in an axial direction by receiving a thrust while rotating. Due to the movement of the photoconductive drum in the axial direction, the process rollers may come into contact with an undesired area (non-contact area) on the surface of the photoconductive drum. Then, a high voltage that is applied to the process rollers may leak via the non-contact area.

DISCLOSURE OF INVENTION

Brief Description of Drawings

FIG. 1 is a schematic configuration diagram illustrating an electrophotographic image forming apparatus according to an example;

FIG. 2 illustrates an example of a connection structure between a photoconductive drum and a process roller;

FIG. 3 is a cross-sectional view of an example of a combination relationship between a groove and a protrusion;

FIGS. 4 and 5 are schematic cross-sectional views of an example of a connection structure between the photoconductive drum and the process roller, wherein FIG. 4 illustrates a state in which the photoconductive drum and the process roller are apart from each other, and FIG. 5 illustrates a state in which the photoconductive drum and the process roller contact each other;

FIGS. 6 and 7 are schematic cross-sectional views of an example of a connection structure between the photoconductive drum and the process roller, wherein FIG. 6 illustrates a state in which the photoconductive drum and the process roller are apart from each other, and FIG. 7 illustrates a state in which the photoconductive drum and the process roller contact each other;

FIG. 8 illustrates an example of a connection structure between a photoconductive drum and a process roller;

FIGS. 9 and 10 are schematic side views of FIG. 8, wherein FIG. 9 illustrates a state in which the separating member is positioned at a first location, and FIG. 10 illustrates a state in which the separating member is positioned at a second location; and FIGS. 11 and 12 illustrate an example of a connection structure between a photoconductive drum and a process roller, wherein FIG. 11 illustrates a state in which a separating member is at a first location, and FIG. 12 illustrates a state in which a separating member is at a second location.

MODE FOR THE INVENTION

The disclosure will now be described more fully with reference to the accompanying drawings, in which examples are shown. Like reference numerals in the drawings denote like elements, and their descriptions will be omitted.

Disclosed are electrophotographic image forming apparatuses in which a process roller moves in accordance with an axial-direction movement of a photoconductive drum to thereby maintain a stable contact location between the process roller and the photoconductive drum.

An electrophotographic image forming apparatus may include a photoconductive drum, a process roller to rotate in a state where the process roller elastically contacts a surface of the photoconductive drum, and a connecting member to allow the process roller to follow a movement of the photoconductive drum in an axial direction of the photoconductive drum.

An electrophotographic image forming apparatus may include a photoconductive drum, a process roller to rotate by elastically contacting a surface of the photoconductive drum, a pinion gear to rotate together when the photoconductive drum rotates in a process direction, and a separating member including a rack gear portion connected to the pinion gear and an insertion portion. The separating member is moved to a first location where the insertion portion is located between the process roller and the photoconductive drum to separate the process roller from the photoconductive drum or to a second location where the insertion portion is escaped from the first location to allow the process roller to contact the photoconductive drum, as the pinion gear rotates.

FIG. 1 is a schematic configuration diagram illustrating an electrophotographic image forming apparatus according to an example. Referring to FIG. 1, the electrophotographic image forming apparatus includes a main body 100 and a developing device 200. An opening 101 providing a passage via which the developing device 200 is mounted/removed may be formed in the main body 100. A cover 300 opens or closes the opening 101. An exposure device 110, a transfer roller 120, and a fixing device 130 are arranged at the main body 100. In addition, a recording medium transport structure 140 for loading and transporting recording media P on which an image is to be formed is arranged at the main body 100.

The developing device 200 includes a photoconductive drum 1. The photoconductive drum 1, as a photoconductor on which an electrostatic latent image is formed, may include a conductive metal pipe and a photosensitive layer formed at an outer circumference of the conductive metal pipe. A charging roller 2 is an example of a charger that charges a surface of the photoconductive drum 1 to have a uniform surface potential. Instead of the charging roller 2, a charging brush, a corona charger, or the like may be used. Reference numeral 3 indicates a cleaning roller that removes foreign substances attached to the surface of the charging roller 2. A cleaning blade 8 is an example of a cleaning member that removes residual toners and foreign substances attached to the surface of the photoconductive drum 1 after a transfer process to be described below. Instead of the cleaning blade 8, a cleaning device in another form, such as a rotating brush, may be used. The toners and foreign substances removed by the cleaning blade 8 are accommodated in a waste toner container 9.

The developing device 200 supplies a toner contained therein to an electrostatic latent image formed on the photoconductive drum 1, thereby developing the electrostatic latent image to a visible toner image. The developing device 200 includes a photoconductive drum 1 and a developing roller 4 opposite to the photoconductive drum 1.

When a one-component developing method is employed, a toner is contained in the developing device 200. The one-component developing method may be classified into a contact developing method in which the developing roller 4 and the photoconductive drum 1 rotate in contact with each other, or a non-contact developing method in which the developing roller 4 and the photoconductive drum 1 are spaced apart from each other by several tens to several hundreds of micrometers and rotate. The developing roller 4 supplies the toner in the developing device 200 to the photoconductive drum 1. A developing bias voltage may be applied to the developing roller 4. The regulating member 5 regulates an amount of toner that is supplied by the developing roller 4 to a development area where the photoconductive drum 1 and the developing roller 4 contact each other. The regulating member 5 may be a doctor blade that elastically contacts a surface of the developing roller 4. The developing device 200 may further include a supply roller 6 that attaches the toner to the surface of the developing roller 4. A supply bias voltage may be applied to the supply roller 6. The developing device 200 may further include an agitator 7 that agitates the toner and supplies the agitated toner toward the supply roller 6 and the developing roller 4. The agitator 7 may agitate and triboelectrically charge the toner. As needed, at least two agitators 7 may be included.

When a two-component developing method is employed, a toner and a carrier are contained in the developing device 200. The developing roller 4 is apart by several tens to several hundreds of micrometers from the photoconductive drum 1. Although not shown in FIG. 1, the developing roller 4 may include a hollow cylindrical sleeve and a magnetic roller fixedly arranged within the hollow cylindrical sleeve. The toner is attached to a surface of the magnetic carrier. The magnetic carrier is attached to the surface of the developing roller 4 and is conveyed to the development area where the photoconductive drum 1 and the developing roller 4 contact each other. Due to a developing bias voltage that is applied between the developing roller 4 and the photoconductive drum 1, the toner is supplied to the photoconductive drum 1, and thus an electrostatic latent image formed on the surface of the photoconductive drum 1 is developed to a visible toner image. The developing device 200 may include a conveying agitator (not shown) that mixes the toner with the carrier, agitates the mixture, and conveys the agitated mixture to the developing roller 4. The conveying agitator may be, for example, an auger, and the developing device 200 may include a plurality of conveying agitators.

Although examples of a developing method of an image forming apparatus according to an example have been described above, the disclosure is not limited thereto, and various modifications may be made to the developing method.

The developing device 200 is an assembly of elements for forming the visible toner image. The developing device 200 is a consumable item to be replaced when its service life is over. The developing device 200 may have any of various structures, such as a structure in which the photoconductive drum 1, the developing roller 4, and a toner containing portion are integrally formed with each other, a structure in which an imaging unit including the photoconductive drum 1 and the developing roller 4 is distinguished from a toner unit in which a toner is contained, and a structure in which a photoconductive drum unit including a photoconductor, a developing unit including a developing roller, and a toner unit in which a toner is contained are distinguished from each other. Each unit may be individually replaced.

The exposure device 110 radiates light modulated in correspondence with image information onto the photoconductive drum 1 and forms the electrostatic latent image on the photoconductive drum 1. Examples of the exposure device 110 may include a laser scanning unit (LSU) using a laser diode as a light source and a light emitting diode (LED) exposure device using an LED as a light source.

The transfer roller 120 is an example of a transfer device that transfers the toner image from the photoconductive drum 1 to the recording medium P. A transfer bias voltage for transferring the toner image to the recording medium P is applied to the transfer roller 120. Instead of the transfer roller 120, a corona transfer device or a pin scorotron-type transfer device may be used.

The recording medium P is picked up from a loading table 141 by the pickup roller 142 sheet-by-sheet, and is transported to an area where the photoconductive drum 1 and the transfer roller 120 contact each other, by transporting rollers 143, 144, and 145.

The fixing device 130 applies heat and pressure to the toner image transferred onto the recording medium P to thereby fix the toner image to the recording medium P. The recording medium P that has passed through the fixing device 130 is discharged to outside of the main body 100 by a discharge roller 146.

According to the above-described structure, the exposure device 110 radiates light modulated in correspondence with image information onto photoconductive drum 1 and forms an electrostatic latent image. The developing roller 4 supplies a toner to the electrostatic latent image and forms a visible toner image on the surface of the photoconductive drum 1. The recording medium P is transported to the area where the photoconductive drum 1 and the transfer roller 120 contact each other, by the pickup roller 142 and the transporting rollers 143, 144, and 145, and the toner image is transferred from the photoconductive drum 1 to the recording medium P due to the transfer bias voltage applied to the transfer roller 120. When the recording medium P passes through the fixing device 130, the toner image is fixed on the recording medium P due to heat and pressure. The recording medium P for which fixing has been completed is discharged by the discharge roller 146.

When double-sided printing is performed, the recording medium P, one surface of which has already been printed on, is transported back to the area where the photoconductive drum 1 and the transfer roller 120 contact each other via a reverse transporting path 150, as the discharge roller 146 rotates backwards. Next, a new toner image is transferred to the other surface of the recording medium P, undergoes a fixing process, and then the recording medium P that has been double-sided printed is discharged by the discharge roller 146.

As described above, an electrophotographic printing process includes charging, developing, and transferring processes performed by a plurality of process rollers, such as the charging roller 2, the developing roller 4, and the transfer roller 120 arranged around the photoconductive drum 1. The charging roller 2 and the transfer roller 120 rotate in contact with the surface of the photoconductive drum 1. When a contact developing method is used, the developing roller 4 also rotates in contact with the surface of the photoconductive drum 1. An elastic force is applied to the process rollers such that they may contact the photoconductive drum 1. The charging roller 2, the developing roller 4, and the transfer roller 120 in contact with the photoconductive drum 1 will now be referred to as process rollers, and a relationship between the process rollers and the photoconductive drum 1 will be described blow.

FIG. 2 illustrates an example of a connection structure between the photoconductive drum 1 and a process roller 400. Referring to FIG. 2, the process roller 400 is pressed to contact a surface of the photoconductive drum 1 due to an elastic force of an elastic member 410. As the photoconductive drum 1 rotates, the process roller 400 is driven due to a contact frictional force with the photoconductive drum 1. The process roller 400 may be rotated by receiving power from a power transmission member (not shown), for example, a gear, coupled to a rotation axis 401 (see FIG. 3) of the process roller 400.

When the photoconductive drum 1 rotates, a force in an axial direction is exerted upon the photoconductive drum 1, and thus the photoconductive drum 1 may move in the axial direction. For example, in cases, such as, when a photoconductive drum gear 510 coupled to an end of the photoconductive drum 1 is a helical gear, when a thickness of a photosensitive layer 12 formed on the surface of the photoconductive drum 1 is not uniform in a lengthwise direction of the photoconductive drum 1, when the process roller 400 has a crown or reverse crown shape and the crown or reverse crown shape is not horizontally symmetrical, and when the process roller 400 and the photoconductive drum 1 are not parallel to each other (i.e., axis distances between the process roller 400 and the photoconductive drum 1 at both ends of the process roller 400 in the lengthwise direction are different from each other), the photoconductive drum 1 and/or the process roller 400 may move in the axial direction.

When the photoconductive drum 1 and the process roller 400 move in connection with each other in the axial direction, a contact location between the photoconductive drum 1 and the process roller 400 in the lengthwise direction may be almost constant. When the photoconductive drum 1 and the process roller 400 do not move in connection with each other in the axial direction, namely, when the photoconductive drum 1 and the process roller 400 move independently in the axial direction, the contact location between the photoconductive drum 1 and the process roller 400 may vary in the lengthwise direction.

Movement amounts of the photoconductive drum 1 and the process roller 400 in the axial direction and movement directions thereof may vary according to the abovementioned factors causing the axial movement of the photoconductive drum 1 and/or the process roller 400, and factors such as a driving torque transmitted to the photoconductive drum 1 and the process roller 400 and an error to the assembly of component parts. Accordingly, the contact location between the photoconductive drum 1 and the process roller 400 may not be maintained constant.

The photoconductive drum 1 includes a conductive pipe 11, and the photosensitive layer 12 formed on a surface of the conductive pipe 11. The process roller 400 contacts the photosensitive layer 12. Because the photosensitive layer 12 is an electrical insulator while not being exposed, when a high voltage, for example, a charging bias voltage, a developing bias voltage, or a transfer bias voltage, is applied to the process roller 400, the high voltage may be maintained between the photosensitive layer 12 and the process roller 400. When the photoconductive drum 1 and the process roller 400 move independently in the axial direction, the process roller 400 may contact an area having no photosensitive layers 12 formed thereon, namely, an outer circumference of the conductive pipe 11. Then, when a high voltage, for example, a charging bias voltage, a developing bias voltage, or a transfer bias voltage, is applied to the process roller 400, the high voltage may leak through the conductive pipe 11, and thus a charging, developing, or transferring defect may occur.

The image forming apparatus according to an example includes a connecting member that connects the photoconductive drum 1 to the process roller 400 such that the photoconductive drum 1 and the process roller 400 may move in the axial direction in connection with each other. In other words, due to the connecting member, the process roller 400 follows the movement of the photoconductive drum 1 in the axial direction. According to this structure, the contact location between the process roller 400 and the photoconductive drum 1 may be maintained constant.

Referring to FIG. 2, the connecting member includes a groove 501 provided on an end of the photoconductive drum 1 in the lengthwise direction thereof, and a protrusion 421 provided on an end of the process roller 400 and inserted into the groove 501. For example, a flange 500 may be fixed to an end of the photoconductive drum 1 in the lengthwise direction thereof, and the groove 501 may be formed on the flange 500. The flange 500 may be formed integrally with the photoconductive drum gear 510. The groove 501 may have a ring shape concavely engraved from an outer circumference of the flange 500 in a radial direction thereof. The protrusion 421 may be provided on a holder 420 coupled to an end of the process roller 400.

FIG. 3 is a cross-sectional view illustrating a combination relationship between the groove 501 and the protrusion 421. Referring to FIG. 3, the holder 420 has a hole 422 into which the rotation axis 401 of the process roller 400 is inserted to be rotatable. The protrusion 421 is inserted into the groove 501. An end 421*a* of the protrusion 421 does not contact a bottom 502 of the groove 501 in order to not affect a contact force between the process roller 400 and the photoconductive drum 1. In other words, while the process roller 400 is in contact with the photoconductive drum 1, the end 421*a* of the protrusion 421 does not contact the bottom 502 of the groove 501. Although not shown in FIG. 3, the protrusion 421 may be in the shape of a disc entirely protruding from an outer circumference of the holder 420.

According to this structure, a movement of the process roller 400 in the axial direction follows a movement of the photoconductive drum 1 in the axial direction. In other words, when the photoconductive drum 1 moves in the axial direction, the protrusion 421 is pushed by the groove 501, and thus the process roller 400 also moves the same amount as a movement amount of the photoconductive drum 1 in the same direction as a movement direction of the photoconductive drum 1. The movement of the process roller 400 in the axial direction is restricted by the groove 501 and the protrusion 421. Accordingly, the contact location between the photoconductive drum 1 and the process roller 400 may be maintained constant, and occurrence of an image defect during charging, developing, and transferring may be prevented.

The holder 420 and the process roller 400 may be coupled to each other such that the process roller 400 follows the movement of the photoconductive drum 1 in the axial direction. For example, according to an example, the flange 500 having the groove 501 formed thereon is provided on each of both ends of the photoconductive drum 1, and the holder 420 having the protrusion 421 is provided on each of both ends of the process roller 400. A step 402 may be provided on each of both ends of the rotation axis 401. According to this structure, when the photoconductive drum 1 moves in a direction D1, the holder 420 provided on the right side of FIG. 2 is pushed in the direction D1, and the holder 420 pushes the step 402 and thus the process roller 400 also moves in the direction D1. When the photoconductive drum 1 moves in a direction D2, the holder 420 provided on the left side of FIG. 2 is pushed in the direction D2, and the holder 420 pushes the step 402 and thus the process roller 400 also moves in the direction D2.

A coupling structure between the holder 420 and the rotation axis 401 is not limited to the above-described example. For example, although not shown in FIG. 3, a locking member that couples the holder 420 to the rotation axis 401 to prevent a movement of the holder 420 in the axial direction, for example, an E-ring, may be locked to the rotation axis 401, on one side or both sides of the holder 420.

The image forming apparatus is exposed to various environments during distribution after being manufactured. When a long time has lapsed while the process roller 400 is in contact with the photoconductive drum 1, the photoconductive drum 1 and the process roller 400 may be physically and chemically damaged. For example, when the photoconductive drum 1 and the process roller 400 are exposed to high temperature and high humidity environments, they may be damaged. Physical and chemical damage to the photoconductive drum 1 and the process roller 400 may cause an image defect. For example, defects may occur in a printed image at intervals of a rotation period of the photoconductive drum 1 or the process roller 400.

To address this, the process roller 400 and the photoconductive drum 1 may be distributed while being apart from each other, and a structure that brings the process roller 400 into contact with the photoconductive drum 1 while the photoconductive drum 1 is rotating when a user uses the image forming apparatus may be employed. According to an example, the connecting member may be used to space apart/bring into contact the photoconductive drum 1 from/with the process roller 400.

FIGS. 4 and 5 are schematic cross-sectional views of an example of a connection structure between the photoconductive drum 1 and the process roller 400. FIG. 4 illustrates a state in which the photoconductive drum 1 and the process roller 400 are apart from each other, and FIG. 5 illustrates a state in which the photoconductive drum 1 and the process roller 400 contact each other.

Referring to FIG. 4, the holder 420 includes a separating portion 423 further protruding beyond the protrusion 421 in a radial direction. The amount of protrusion of the separating portion 423 is determined such that the process roller 400 may be apart from the photoconductive drum 1 when in contact with the bottom 502 of the groove 501. Although not shown in FIGS. 4 and 5, the protrusion 421 may be in the shape of a disc entirely protruding from the outer circumference of the holder 420, and the separating portion 423 may be shaped to protrude from the disc-shaped protrusion 421.

The holder 420 has a first rotational location (FIG. 4) in which the separating portion 423 contacts the bottom 502 of the groove 501 and thus separates the process roller 400 from the photoconductive drum 1, and a second rotational location (FIG. 5) in which the separating portion 423 is spaced apart from the bottom 502 of the groove 501 and the protrusion 421 is inserted into the groove 501. The holder 420 is rotatable with respect to the process roller 400 and may be rotated from the first rotational location to the second rotational location.

According to the example, a rotation of the holder 420 from the first rotational location to the second rotational location is in connection with a rotation of the photoconductive drum 1 in a process direction PR. At the first rotational location, the separating portion 423 is in contact with the bottom 502 of the groove 501, and the separating portion 423 presses the bottom 502 due to an elastic force of the elastic member 410. Accordingly, when the photoconductive drum 1 rotates in the process direction PR, the holder 420 may be rotated due to a friction between the bottom 502 and the separating portion 423.

First, referring to FIG. 4, the separating portion 423 is positioned at the first rotational location in which the separating portion 423 contacts the bottom 502 of the groove 501 and accordingly separates the process roller 400 from the photoconductive drum 1. The separating portion 423 is maintained to be in contact with the bottom 502 of the groove 501 due to the elastic force of the elastic member 410, and the process roller 400 is maintained to be apart from the photoconductive drum 1.

When an operation of the image forming apparatus starts in this state, the photoconductive drum 1 is rotated in the process direction PR as shown in FIG. 5. Because the separating portion 423 is in contact with the bottom 502 of the groove 501, the holder 420 is rotated due to the friction between the separating portion 423 and the bottom 502 of the groove 501. The process roller 400 approaches the photoconductive drum 1 due to the elastic force of the elastic member 410. When the contact between the separating portion 423 and the bottom 502 is terminated, the process roller 400 contacts the photoconductive drum 1. The holder 420 reaches the second rotational location, and the protrusion 421 is inserted into the groove 501. Accordingly, at the second rotational location, the process roller 400 may follow the movement of the photoconductive drum 1 in the axial direction.

According to this structure, when the manufacture of the image forming apparatus is completed, the image forming apparatus is distributed while the holder 420 is being at the first rotational location. Accordingly, physical and chemical damage to the photoconductive drum 1 and the process roller 400 due to long-time maintenance of a contact between the process roller 400 and the photoconductive drum 1, and an image defect due to the physical and chemical damage to the photoconductive drum 1 and the process roller 400 may be prevented. When a user obtains the image forming apparatus and an operation of the image forming apparatus starts, the process roller 400 is in contact with the photoconductive drum 1 while the holder 420 is rotating to the second rotational location, and accordingly the image forming apparatus is in a printable state. Accordingly, the user does not need a manipulation for making the process roller 400 in contact with the photoconductive drum 1, and thus user convenience may be improved.

The above-described issues which may occur due to a long-time contact between the process roller 400 and the photoconductive drum 1 may be addressed by using a removable separating member.

FIGS. 6 and 7 are schematic cross-sectional views of an example of a connection structure between the photoconductive drum 1 and the process roller 400. FIG. 6 illustrates a state in which the photoconductive drum 1 and the process roller 400 are apart from each other, and FIG. 7 illustrates a state in which the photoconductive drum 1 and the process roller 400 contact each other. In the example of FIGS. 6 and 7, a removable separating member 600 is employed.

Referring to FIG. 6, the separating member 600 is inserted between the process roller 400 and the photoconductive drum 1 and separates the process roller 400 from the photoconductive drum 1. For example, the separating member 600 is inserted into the groove 501. The protrusion 421 contacts the separating member 600. Accordingly, the protrusion 421 is not inserted into the groove 501 or is incompletely inserted into the groove 501, and thus the process roller 400 is separated from the photoconductive drum 1. The removable separating member 600 may be partially exposed to outside of a housing 201 (see FIG. 1) of the developing device 200 such that a user may access the removable separating member 600.

When the separating member 600 is removed as shown in FIG. 7, the process roller 400 is pushed toward the photoconductive drum 1 due to the elastic force of the elastic member 410, and the protrusion 421 is inserted into the groove 501. The process roller 400 contacts the photoconductive drum 1. At this time, as described above, the protrusion 421 is spaced apart from the bottom 502 of the groove 501. Because the protrusion 421 is in a state of being inserted into the groove 501, the process roller 400 may follow the movement of the photoconductive drum 1 in the axial direction.

When the process roller 400 is the transfer roller 120, the separating member 600 is removed after the developing device 200 is removed from the main body 100, and thus the holder 420 does not rotate while the separating member 600 is being removed. When the process roller 400 is the charging roller 2 or the developing roller 4, even when the developing device 200 is removed from the main body 100, the protrusion 421 presses the separating member 600 due to the elastic force of the elastic member 410. Accordingly, while the separating member 600 is being removed, the holder 420 may be rotated. When the protrusion 421 partially protrudes from the outer circumference of the holder 420 as shown in FIGS. 6 and 7, a width W of the protrusion 421 may be determined such that the holder 420 is not rotated when the separating member 600 is removed. According to this structure, when the process roller 400 contacts the photoconductive drum 1 after the separating member 600 is removed, the protrusion 421 may be inserted into the groove 501. Although not shown in FIGS. 6 and 7, when the protrusion 421 has a disc shape and the process roller 400 is in contact with the photoconductive drum 1 even when the holder 420 rotates while the separating member 600 is being removed, the protrusion 421 may be inserted into the groove 501.

According to this structure, when the manufacture of the image forming apparatus is completed, the image forming apparatus is distributed while the separating member 600 is being inserted into the groove 501. Accordingly, physical and chemical damage to the photoconductive drum 1 and the process roller 400 due to long-time maintenance of a contact between the process roller 400 and the photoconductive drum 1, and an image defect due to the physical and chemical damage to the photoconductive drum 1 and the process roller 400 may be prevented. When a user obtains the image forming apparatus, the user makes the process roller 400 in contact with the photoconductive drum 1 by removing the separating member 600 before using the image forming apparatus. The image forming apparatus is in a printable state. Moreover, because the protrusion 421 is inserted into the groove 501, the process roller 400 may follow the movement of the photoconductive drum 1 in the axial direction.

An example in which the separating member 600 is escaped from the groove 501 when the image forming apparatus operates, namely, in connection with a rotation of the photoconductive drum 1 in the process direction PR is possible.

FIG. 8 illustrates an example of a connection structure between the photoconductive drum 1 and the process roller 400. FIG. 9 is a schematic side view of FIG. 8, and illustrates a state in which the separating member 600 is positioned at a first location. FIG. 10 is a schematic side view of FIG. 8, and illustrates a state in which the separating member 600 is positioned at a second location. In FIGS. 9 and 10, the process roller 400 and the holder 420 are omitted.

Referring to FIGS. 8 through 10, the separating member 600 includes an insertion portion 610 and a rack gear portion 620. The insertion portion 610 is inserted into the groove 501 or escaped from the groove 501 according to a location of the separating member 600. As the photoconductive drum 1 rotates in the process direction PR, the separating member 600 is moved from the first location, where the insertion portion 610 has been inserted into the groove 501, to the second location, where the insertion portion 610 has been escaped from the groove 501. At the first location, the insertion portion 610 is positioned between the bottom 502 of the groove 501 and the protrusion 421 and separates the process roller 400 from the photoconductive drum 1. At the second location, the insertion portion 610 is escaped from between the bottom 502 of the groove 501 and the protrusion 421 and allows the protrusion 421 to be inserted into the groove 501 and the process roller 400 to contact the photoconductive drum 1.

The separating member 600 may be supported to be slidable to the housing 201 (see FIG. 1) of the developing device 200. A pinion gear that interlocks with the rack gear portion 620 is provided to move the separating member 600 from the first location to the second location. The pinion gear also rotates when the photoconductive drum 1 rotates in the process direction PR. The pinion gear may be, for example, the photoconductive drum gear 510 coupled to the photoconductive drum 1.

Referring to FIG. 9, the separating member 600 is positioned at the first location. The insertion portion 610 is located on the groove 501. The protrusion 421 contacts the insertion portion 610. The protrusion 421 is not inserted into the groove 501 or is insufficiently inserted into the groove 501, and the process roller 400 is separated from the photoconductive drum 1. The rack gear portion 620 interlocks with the photoconductive drum gear 510.

When an operation of the image forming apparatus starts in this state and the photoconductive drum gear 510 rotates in the process direction PR, the separating member 600 slides and moves to the second location as shown in FIG. 10. The insertion portion 610 is escaped from the groove 501. Then, the process roller 400 contacts the photoconductive drum 1 due to the elastic member 410, and the protrusion 421 is inserted into the groove 501. At this time, as described above, the protrusion 421 is spaced apart from the bottom 502 of the groove 501. Because the protrusion 421 is in a state of being inserted into the groove 501, the process roller 400 may follow the movement of the photoconductive drum 1 in the axial direction.

When the protrusion 421 has a shape partially protruding from the outer circumference of the holder 420 as shown in FIGS. 8 through 10, the width W (see FIG. 6) of the protrusion 421 may be determined such that the holder 420 does not rotate when the separating member 600 is removed. According to this structure, when the process roller 400 contacts the photoconductive drum 1 after the separating member 600 is removed, the protrusion 421 may be inserted into the groove 501. Although not shown in FIGS. 8 through 10, when the protrusion 421 has a disc shape and the process roller 400 is in contact with the photoconductive drum 1 even when the holder 420 rotates while the separating member 600 is being removed, the protrusion 421 may be inserted into the groove 501.

Interlocking between the rack gear portion 620 and the photoconductive drum gear 510 at the second location is released. Accordingly, even when the photoconductive drum 1 rotates in a reverse direction to the process direction PR, the separating member 600 does not return to the first location.

According to this structure, when the manufacture of the image forming apparatus is completed, the image forming apparatus is distributed while the separating member 600 is at the first location. Accordingly, physical and chemical damage to the photoconductive drum 1 and the process roller 400 due to long-time maintenance of a contact between the process roller 400 and the photoconductive drum 1, and an image defect due to the physical and chemical damage to the photoconductive drum 1 and the process roller 400 may be prevented. When a user obtains the image forming apparatus and an operation of the image forming apparatus starts, as the photoconductive drum 1 rotates in the process direction PR, the separating member 600 slides to the second location and the process roller 400 contacts the photoconductive drum 1, and thus the image forming apparatus is in a printable state. Accordingly, the user does not need a manipulation for making the process roller 400 in contact with the photoconductive drum 1, and thus user convenience may be improved. Moreover, because the protrusion 421 is inserted into the groove 501, the process roller 400 may follow the movement of the photoconductive drum 1 in the axial direction.

FIGS. 11 and 12 illustrate an example of a connection structure between the photoconductive drum 1 and the process roller 400. FIG. 11 illustrates a state in which the separating member 600 is positioned at a first location. FIG. 12 illustrates a state in which the separating member 600 is positioned at a second location. The example of FIGS. 11 and 12 is different from the example of FIGS. 8 through 10 in that a pinion gear 630 rotates in connection with the photoconductive drum gear 510. In the example of FIGS. 11 and 12, an escaping direction of the separating member 600 is a reverse direction to that in the example of FIGS. 8 through 10.

In the example of FIGS. 8 through 12, a structure for moving the process roller 400 from a location where the process roller 400 is apart from the photoconductive drum 1 to a location where the process roller 400 contacts the photoconductive drum 1, as the photoconductive drum 1 is driven in the process direction PR forms the concept of a disclosure. The electrophotographic image forming apparatus includes the pinion gear 510 or 630 also rotating when the photoconductive drum 1 rotates in a process direction, and the separating member 600. The separating member 600 includes the rack gear portion 620 connected to the pinion gear 510 or 630 and moves to the first location (FIGS. 9 and 11) where the separating member 600 is interposed between the process roller 400 and the photoconductive drum 1 and separates the process roller 400 from the photoconductive drum 1 or to the second location (FIGS. 10 and 12) where the separating member 600 is escaped from the first location and the process roller 400 contacts the photoconductive drum 1 with a rotation of the pinion gear. When the separating member 600 is at the second location, interlocking between the rack gear portion 620 and the pinion gear 510 or 630 is released. Although not shown in FIGS. 8 through 12, at the first location, the separating member 600 may be positioned between a surface of the photoconductive drum 1 and the process roller 400. At the first location, the separating member 600 may be positioned between the surface of the photoconductive drum 1 and the holder 420 supported such that the process roller 400 is rotatable. The flange 500 may be coupled to an end of the photoconductive drum 1 in the lengthwise direction thereof, and, at the first location, the separating member 600 may be positioned between the flange 500 and the holder 420.

According to this structure, because the image forming apparatus is distributed while the separating member 600 is being at the first location, an image defect due to the long-time maintenance of the process roller 400 in contact with the photoconductive drum 1 may be prevented. Moreover, when an operation of the image forming apparatus starts, the separating member 600 is moved to the second location and thus the image forming apparatus is in a printable state, leading to an improvement in user convenience.

The aforementioned examples of a connection structure between the photoconductive drum 1 and the process roller 400 are applicable between the photoconductive drum 1 and the charging roller 2, between the photoconductive drum 1 and the developing roller 4, and between the photoconductive drum 1 and the transfer roller 120.

According to the above-described examples of the electrophotographic image forming apparatus, stability of a contact location between a process roller and a photoconductive drum may be maintained, and a stable image may be realized.

According to the above-described examples of the electrophotographic image forming apparatus, the process roller and the photoconductive drum may contact each other/may be apart from each other.

While examples have been described with reference to the drawings, it will be understood by those of ordinary skill in the art that various changes in form and details may be made therein without departing from the spirit and scope as defined by the following claims.

The invention claimed is:

1. An electrophotographic image forming apparatus, comprising:

a photoconductive drum;

a process roller to rotate in a state in which the process roller elastically contacts a surface of the photoconductive drum; and a connecting member to allow the process roller to follow a movement of the photoconductive drum in an axial direction of the photoconductive drum so as to maintain a contact location between the process roller and the photoconductive drum in the axial direction, the connecting member comprising a first member attached to the process roller, and a second member attached to the photoconductive drum, wherein a motion of the photoconductive drum along the axial direction causes the second member to push the first member and move the process roller by a corresponding amount along the axial direction.

2. The electrophotographic image forming apparatus of claim 1, wherein the axial direction of the photoconductive drum is along an axis about which the photoconductive drum rotates during an operation of the electrophotographic image forming apparatus.

3. The electrophotographic image forming apparatus of claim 1, wherein the first member comprises a protrusion, and the second member comprises a groove into which the protrusion is inserted.

4. The electrophotographic image forming apparatus of claim 1, wherein a movement of the process roller in the axial direction relative to the photoconductive drum is restricted by the first member and the second member.

5. The electrophotographic image forming apparatus of claim 1, further comprising:

a separating member moveable between:

a first location at which the separating member causes the process roller to be spaced apart from the photoconductive drum, and a second location at which the separating member allows the process roller to physically contact the photoconductive drum.

6. The electrophotographic image forming apparatus of claim 5, wherein the separating member is rotatable between the first location and the second location.

7. An electrophotographic image forming apparatus, comprising:

a photoconductive drum;

a process roller to rotate in a state in which the process roller elastically contacts a surface of the photoconductive drum; and a connecting member to allow the process roller to follow a movement of the photoconductive drum in an axial direction of the photoconductive drum so as to maintain a contact location between the process roller and the photoconductive drum in the axial direction, wherein the connecting member comprises:

a flange fixed to an end of the photoconductive drum in a lengthwise direction of the photoconductive drum, the flange including a groove concavely engraved in a radial direction of the photoconductive drum, and a holder, provided on the process roller, the holder including a protrusion insertable into the groove and, when the protrusion is inserted into the groove, the protrusion is spaced apart from a bottom of the groove.

8. The electrophotographic image forming apparatus of claim 7, wherein the process roller is rotatably supported by the holder.

9. The electrophotographic image forming apparatus of claim 7, wherein the holder further includes a separating portion protruding beyond the protrusion in a radial direction of the holder, and the holder is movable between:

a first rotational location in which the separating portion contacts the bottom of the groove and separates the process roller from the photoconductive drum, and a second rotational location in which the separating portion is spaced apart from the bottom of the groove and the protrusion is inserted into the groove.

10. The electrophotographic image forming apparatus of claim 9, wherein, when the holder is in the first rotational location and the photoconductive drum rotates, the holder moves from the first rotational location to the second rotational location.

11. The electrophotographic image forming apparatus of claim 7, further comprising:

a pinion gear to rotate together with the photoconductive drum when the photoconductive drum rotates in a process direction; and a separating member comprising:

a rack gear portion to engage the pinion gear, and an insertion portion, wherein the separating member is movable, according to the rotation of the pinion gear, between:

a first location in which the insertion portion is located between the bottom of the groove and the protrusion to separate the process roller from the photoconductive drum, and a second location in which the insertion portion is released from between the bottom of the groove and the protrusion.

12. The electrophotographic image forming apparatus of claim 11, wherein, when the separating member is located at the second location, engagement of the rack gear portion with the pinion gear is released.

13. The electrophotographic image forming apparatus of claim 11, wherein the pinion gear is a photoconductive drum gear provided on an end of the photoconductive drum.

14. The electrophotographic image forming apparatus of claim 11, further comprising a photoconductive drum gear provided on an end of the photoconductive drum, wherein the pinion gear engages the photoconductive drum gear to rotate in connection with rotation of the photoconductive drum gear.

15. The electrophotographic image forming apparatus of claim 1, wherein the process roller comprises at least one of a charging roller to charge a surface of the photoconductive drum to have a uniform potential, a developing roller to form a visible toner image by supplying a toner on an electrostatic latent image formed on the surface of the photoconductive drum, or a transferring roller to transfer a toner image formed on the surface of the photoconductive drum to a recording medium.

16. An electrophotographic image forming apparatus, comprising:

a photoconductive drum;

a process roller to rotate by elastically contacting a surface of the photoconductive drum;

a pinion gear to rotate when the photoconductive drum rotates in a process direction; and a separating member comprising:

a rack gear portion to engage the pinion gear, and an insertion portion movable, according to the rotation of the pinion gear, between a first location at which the insertion portion is located between the process roller and the photoconductive drum to separate the process roller from the photoconductive drum, and a second location at which the insertion portion is withdrawn from the first location to allow the process roller to contact the photoconductive drum.

17. The electrophotographic image forming apparatus of claim 16, wherein, when the insertion portion is located at the second location, engagement of the rack gear portion with the pinion gear is released.

18. The electrophotographic image forming apparatus of claim 17, further comprising:

a flange coupled to an end of the photoconductive drum in a lengthwise direction of the photoconductive drum; and a holder to rotatably support the process roller, wherein, at the first location, the insertion portion is located between the flange and the holder.

19. The electrophotographic image forming apparatus of claim 17, wherein the pinion gear is a photoconductive drum gear provided on an end of the photoconductive drum.

20. The electrophotographic image forming apparatus of claim 17, further comprising a photoconductive drum gear provided on an end of the photoconductive drum, wherein the pinion gear engages the photoconductive drum gear to rotate in connection with rotation of the photoconductive drum gear.

* * * * *